US005190479A

United States Patent [19]

Jordi

[11] Patent Number: 5,190,479

[45] Date of Patent: Mar. 2, 1993

[54] ELECTRICAL CONNECTOR INCORPORATING EMI/RFI/EMP ISOLATION

[75] Inventor: Albert E. Jordi, Anoka, Minn.

[73] Assignee: Honeywell Inc., Minneapolis, Minn.

[21] Appl. No.: 768,180

[22] Filed: Sep. 30, 1991

[51] Int. Cl.[5] ..... H01R 13/66

[52] U.S. Cl. ..... 439/620; 333/185

[58] Field of Search ..... 439/607, 608, 620; 333/181-185

[56] References Cited

U.S. PATENT DOCUMENTS 3,121,188 2/1964 Foster .
3,141,999 7/1964 Schneider ..... 165/80
3,157,828 11/1964 Flaherty .
4,572,600 2/1986 Nieman .
4,582,385 4/1986 Couper et al. .
4,600,262 6/1986 Nieman .
4,699,590 10/1987 Farrar et al. ..... 439/620
4,746,310 5/1988 Morse et al. ..... 439/620
4,747,789 5/1988 Gliha ..... 439/620
4,789,360 12/1988 Paul et al. ..... 439/620
4,820,174 4/1989 Farrar et al. ..... 439/95
4,858,072 8/1989 Chall, Jr. ..... 361/388
4,953,058 8/1990 Harris ..... 361/383
5,057,041 10/1991 Yu et al. ..... 439/620

*Primary Examiner*—Neil Abrams
*Attorney, Agent, or Firm*—Robert A. Pajek

[57] ABSTRACT

A female connector receptacle has been designed to incorporate replaceable modules for effecting EMI/RFI/EMP protection for the electronics with which the connector is used. The receptacle comprises a shell having sufficient depth to receive the male plug therein along with the replaceable EMI/RFI modules and the EMP modules for all of the signal lines and power connections for the electronics assembly. The protection modules are inserted through the front of the shell and plug into one another and into a substrate having a corresponding pattern of socket contacts.

13 Claims, 3 Drawing Sheets

ELECTRICAL CONNECTOR INCORPORATING EMI/RFI/EMP ISOLATION

BACKGROUND OF THE INVENTION

1. Field of the Invention

This invention relates generally to electrical connectors for connecting electrical devices or parts to a cable harness, and more particularly to a connector assembly incorporating active and passive circuit elements for effectively isolating the electrical assembly with which the connector is used from electromagnetic interference (EMI), radio frequency interference (RFI), and electromagnetic transient pulses (EMP).

2. Discussion of the Prior Art

Present-day commercial and military aircraft incorporate complexed electronic control systems incorporating numerous sensors and force transducers as well as the electronics necessary for processing the sensor signals and developing the requisite control signals for the transducers so that the aircraft can be flown in a controlled manner. Typically, the electronic assemblies involved will be housed in metallic shielding enclosures or boxes which are adapted to slide into equipment racks on the aircraft. Each of the electronic modules will typically incorporate a receptacle having a large number of terminal pins arranged in a grid and which are appropriately wired to the electronic componentry within the shielded enclosure. Incorporated into the rack assembly is a plug member which is adapted to mate with the receptacle on the box housing the electronics module. The pins of the plug are typically connected to conductors in a wiring harness leading off to other electronic equipment which may be spread throughout the aircraft.

A standard plug used throughout the aircraft industry is referred to as the ARINC 600 plug, which meets the ARINC specifications for air transport avionics equipment interfaces. That specification, among other things, defines the number of pins, their location, the pin spacing and the shell dimensions for the plug. Those desiring specific information relative to the plug are referred to the ARINC 600 specification itself.

The ARINC 600 plug is designed to mate with a receptacle attached to or formed into a wall of the shielding enclosure in which the electronics are contained. The ARINC 600 plug includes three sections with sections A and B incorporating 150 male pins, each disposed in a grid array of rows and columns. Section C includes a smaller number of pins which, generally speaking, provide the power connections to the electronics module. The existing receptacle, designed to accept the plug, includes a plurality of terminal pins having female sockets on one end and male wire wrap terminals or solder points on the other end. The pins are arranged in the same grid array, such that when the plug is inserted into the receptacle, the male pins of the plug engage the female sockets of the receptacle's terminal pins. The male portion of the receptacle's terminal pins then connect to the wiring for the electronics within the shielded enclosure.

The above-described prior art plug/connector receptacle combination has a number of inherent drawbacks. First of all, the replacement of a connector receptacle because of a worn or damaged terminal pin involves the need to open the shielding enclosure and the disassembly of all of the wire wrap or solder connections from the connector receptacle. This is time consuming and may be quite costly in terms of the down-time for the involved aircraft.

Another drawback of the prior art ARINC 600 connector design is that it does not provide the necessary immunity of the electronic circuitry from the effects of EMI, RFI and EMP. Thus, for example, a lightning strike near the aircraft may induce a high voltage transient pulse (EMP) into the conductors of the wiring harness in the aircraft. Such transient pulses are oftentimes of an amplitude that can destroy CMOS circuitry forming a part of the electronics module with which the ARINC 600 connector is used. Similarly, EMI and RFI radiation in proximity to the module may find its way into the interior of the shielded enclosure via the connector assembly. These RFI/EMI and EMP sources may result in the electronic controls issuing erroneous data to the other electronic equipment with which it is associated, resulting in loss of control over the aircraft.

While filtering and transient suppression circuits have been devised for dealing with RFI/EMI and EMP radiation, physical space constraints may preclude inclusion of such circuitry within the electronics module. A need, therefore, exists for a connector plug receptacle assembly which can accommodate transient and noise suppression circuitry which can be replaced without having to enter the shielding enclosure containing the printed circuit cards and componentry. Moreover, the connector must be constructed such that it cannot allow erroneous data to be transmitted out to the devices being controlled.

There is disclosed in the Paul et al. U.S. Pat. No. 4,789,360 and the Morse et al. U.S. Pat. No. 4,746,310, each assigned to Amphenol Corporation, electrical connectors having transient suppression components incorporated therein. Moreover, the connector is designed such that the contact pins have mating forward and rearward end portions and a medial portion which includes a circuit protection element in the form of a silicon diode or varistor. Because of the manner in which the connector pins are designed, it is possible to remove the forward end portion to allow repair or replacement of the circuit detection component. The physical size of the silicon diodes and varistors and their mode of attachment to the connector pins drastically limits the number of pins that can be accommodated in a given area. Thus, the approach disclosed in those two Amphenol Corporation's patents is impractical in implementing a EMI/RFI/EMP connector receptacle compatible with the existing ARINC 600 plug having up to 300 plus pins in an area of only about 7 square inches.

Other prior art patents of interest are owned by International Telephone & Telegraph Corp. and include the Couper et al. U.S. Pat. No. 4,582,385, U.S. Pat. Nos. 4,600,262 and 4,572,600 to Nieman and the Brancaleone et al. U.S. Pat. No. 3,790,858. These patents describe a circumferential connector plug/receptacle combination in which an electrical component is mounted on the side of each contact. As with the Amphenol connectors described above, the approach used in the IT&T patents for achieving EMI/RFI/EMP protection is somewhat wasteful of real estate, making the approach practical only for connectors having relatively few contact pins embodied therein.

OBJECTS

It is accordingly a principal object of the present invention to provide an improved connector receptacle assembly for a shielded enclosure containing digital and/or analog control circuits which permits repair and/or replacement of the connector receptacle without the necessity of opening the shielding enclosure.

Another object of the invention is to provide an improved connector receptacle which can mate with an industry standard plug and which incorporates circuitry for attenuating and limiting various forms of electromagnetic radiation from deleteriously affecting the operation of the control electronics.

Another object of the invention is to provide an improved receptacle containing a large plurality of terminal pins which will mate with an industry standard plug and in which EMP (lightning) protection and EMI/RFI are effectively filtered, but where the connector receptacle will still fit in the space allocated for it on the electronics module.

Still a further object of the invention is to provide a connector receptacle of the type described in which the contacts are removable and replaceable through the front of the receptacle.

SUMMARY OF THE INVENTION

The foregoing features and objects of the invention are achieved by providing an electrical connector receptacle for use with electronic apparatus contained within a shielding enclosure which is designed to mate with an industry standard plug. The plug is of the type having a plurality of male pins arranged in a grid of rows and columns where the male pins are electrically and mechanically joined to a multi-conductor wiring harness. The connector receptacle comprises a generally rectangular, box-like conductive shell mounted in a wall of the shielding enclosure. The shell has four mutually perpendicular side walls defining a housing cavity with open front and rear faces. The housing cavity is dimensioned to receive the aforementioned industry standard plug when it is inserted through the open front face of the shell. Affixed to the shell, proximate its open rear face, is a removable frame which supports a flat substrate containing a plurality of socket contacts arranged in the same grid pattern of rows and columns as is used for the male pins on the plug. The substrate also includes a plurality of terminal pins fitted into the socket contacts where the terminal pins project outwardly and rearwardly with respect to the shell and thereby provide the points where the wiring of the electronic apparatus within the shielding enclosure can be connected.

To provide attenuation of EMI and RFI noise, incorporated into the connector receptacle is a first module dimensioned to fit within the housing cavity through the open front face, the module being a generally rectangular block having first and second opposed major surfaces. The block includes a plurality of contact pins which extend between and a predetermined distance beyond the first and second opposed major surfaces and which are spaced in accordance with the same grid pattern used for the terminal pins on the plug and the socket contacts used on the substrate affixed to the rear face of the shell. The plurality of contact pins have a first end insertable into the socket contacts on the substrate and a second end defining a female socket. Also included in the EMI/RFI module is filter circuitry operatively coupled between selected ones of the contact pins and the conductive shell for attenuating high frequency noise signals.

To provide EMP immunity, the housing cavity in the shell is also designed to receive a second module, also in the form of a rectangular block having first and second opposed major surfaces. This block, like the EMI/RFI module, also includes a plurality of contact pins extending between those two surfaces. The contact pins are again spaced in accordance with the same grid pattern and each of the pins is designed to have a first end thereof insertable into the female socket of the contact pins of the EMI/RFI module and a second end defining a female socket for receiving a male pin of the plug. The EMP module incorporates transient voltage suppression devices which are operatively coupled between selected ones of the contact pins and the conductive shell for creating an active barrier between transient spikes induced in the wiring harness of the aircraft and the electronic apparatus contained within the shielding box or enclosure. Selected ones of the pins in the EMP module may also include a fusible link for preventing potentially damaging current levels from entering the electronics module.

In that the EMI/RFI module and the EMP module are each removable through the front of the connector receptacle, the contacts of the receptacle are removable and replaceable without the necessity of opening the metal box containing the electronics should repair or replacement become necessary. Moreover, because the frame supporting the substrate having the socket contact pattern can be decoupled from the rear surface of the receptacle shell, it is possible to remove the entire receptacle shell and the EMI/RFI/EMP modules without having to disconnect all of the wire wrap or solder connections joining the female receptacle to the electronics contained within the shielding enclosure.

DESCRIPTION OF THE DRAWINGS

The present invention also contemplates the use of the feed-through module which is generally identical to the filter/protection modules in terms of its block-like configuration and the inclusion of an array of pins. It differs, however, in not incorporating active or passive components. The feed-through module permits an industry standard plug, e.g., the ARINC 600 plug, to mate with the receptacle which has a greater shell depth than the prior art standard.

The foregoing features, objects, and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
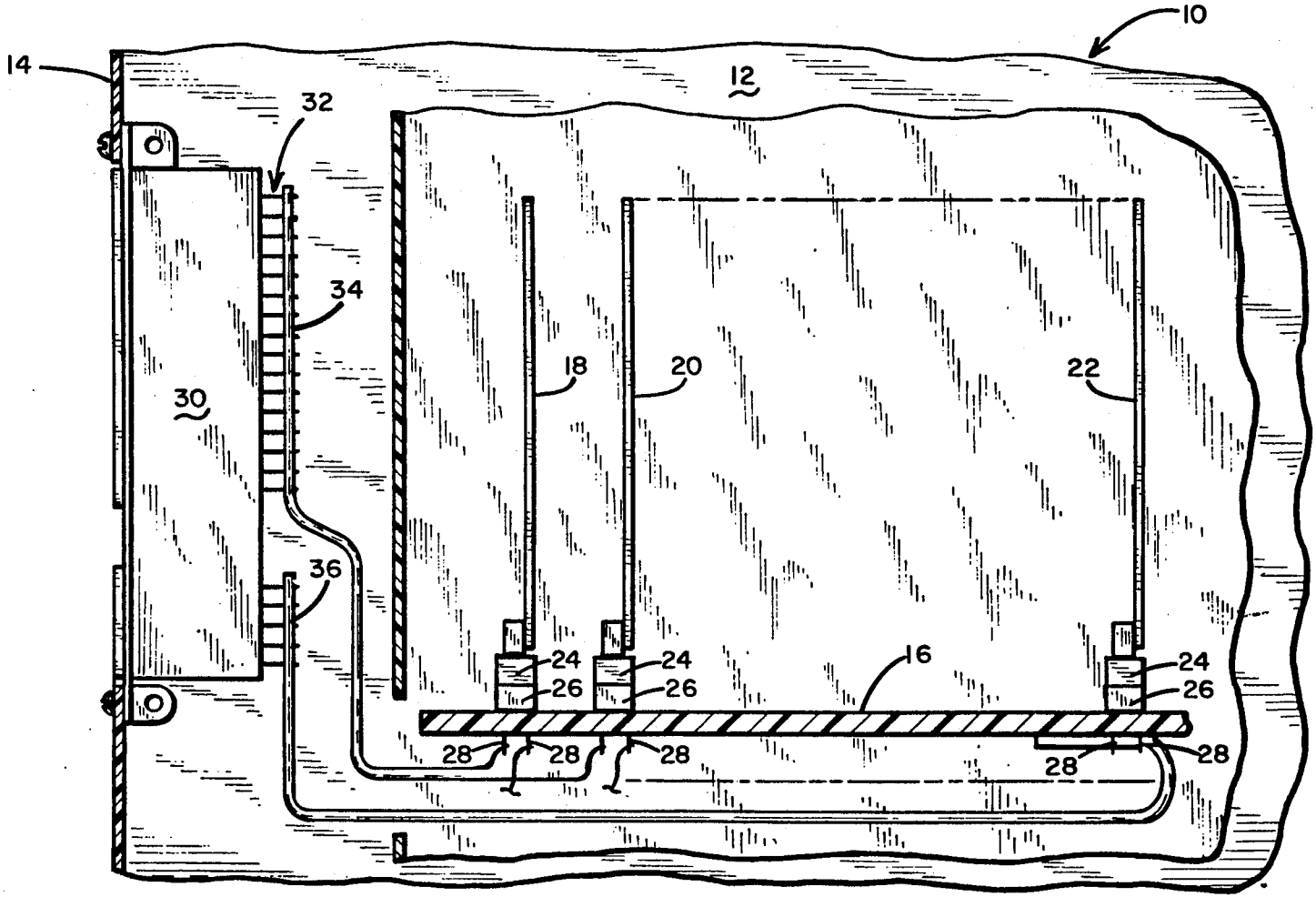
FIG. 1 is a partially sectioned, broken-away view of an electronics module incorporating the connector receptacle of the present invention.

Referring first to FIG. 1, there is indicated generally by numeral 10 a typical electronics box which may be found in an aircraft, a naval vessel or other land-based installation. The box 10 will typically be fabricated from metal, such as sheet aluminum. In FIG. 1, only a portion of the far side of the box 12 and its front face 14 are shown so as to reveal the inner constructional features of the box. Such a box would also include four other mutually perpendicular walls forming a top, bottom, near side and rear. Mounted within the box 10 is a printed circuit board 16 termed a "motherboard" and a plurality of "daughterboards" 18, 20 . . . 22 plugged onto the motherboard. As is known in the art, the motherboard and daughterboards will typically support various active and passive electronic components comprising an electronics module. The daughterboards are shown as being joined to the motherboard 16 by means of appropriate electrical printed circuit board connectors 24-26 of a conventional design well known in the art.

Projecting from the undersurface of the motherboard 16 are a plurality of conductive pins 28 which are joined on the opposite side of the board to a pattern of printed circuitry on the motherboard. To establish an electrical interconnect to equipment outside of the box 10, the terminal pins 28 are electrically joined to a connector plug receptacle 30 comprising the present invention. More particularly, and as will be described in greater detail hereinbelow, the terminals 28 on the motherboard may be connected to predetermined ones of the pin terminals 32 extending from the rear of the plug receptacle 30 by either discrete wiring using wire-wrap connections or, alternatively, by means of printed circuit conductors formed on a flexible insulating substrate or other connecting media. The flex circuitry is identified by numerals 34 and 36 in FIG. 1.

While perhaps not apparent from the view of FIG. 1, as will be appreciated by those skilled in the art, in many applications, such as in aircraft control systems, space is very much at a premium. Thus, the box 10 is made as small as possible consistent with the density of the printed circuit boards 18, 20 ... 22 which must be contained and the temperature constraints imposed on the electronic circuit components housed therein. The box 10 will typically slide into a rack having a male connector plug projecting from a surface thereof to mate with the receptacle 30. The plug (not shown) comprises a termination of a multi-conductor cable or wiring harness which leads to remote areas of the aircraft, ship, etc., containing the other equipment and input sensors.

As is set forth in the introductory portions of this specification, it is imperative that the electronics contained within the box 10 be rendered immune from emitting erroneous control information, via the aforementioned multi-conductor cable leading to the controlled structures due to the introduction of EMI/RFI and EMP through the connector 30. Thus, it is imperative that the electronic components be isolated from radio frequency interference, electromagnetic noise and high voltage pulse-type transients. For the most part, the conductive box 10 is effectively grounded when in position in its equipment rack and it acts as a shield preventing EMI/RFI from penetrating and reaching the sensitive electronic components on the motherboard 16 and the daughterboards 18, 20 . . . 22. However, if such EMI/RFI and EMP radiation are able to penetrate the enclosure via the connector 30, the circuitry can be impacted and caused to emit wrong information.

To obviate this possibility, it might be possible to incorporate appropriate filter circuitry and high voltage transient suppression circuitry within the box 10 which is operatively coupled to the conductors joining the connector pins 32 on the connector receptacle to the terminal pins 28 on the motherboard. However, when space is at a premium, this may not be an effective solution in that there is simply not sufficient room within the box 10 for the required filtering and transient suppression circuitry.

In accordance with the present invention, rather than incorporating the filtering and transient suppression circuitry within the confines of the box 10, that circuitry is, instead, operatively disposed within the confines of the connector receptacle 30. The way in which this is accomplished will next be explained with the aid of the blown-apart drawing of FIG. 2.

Figure 2:
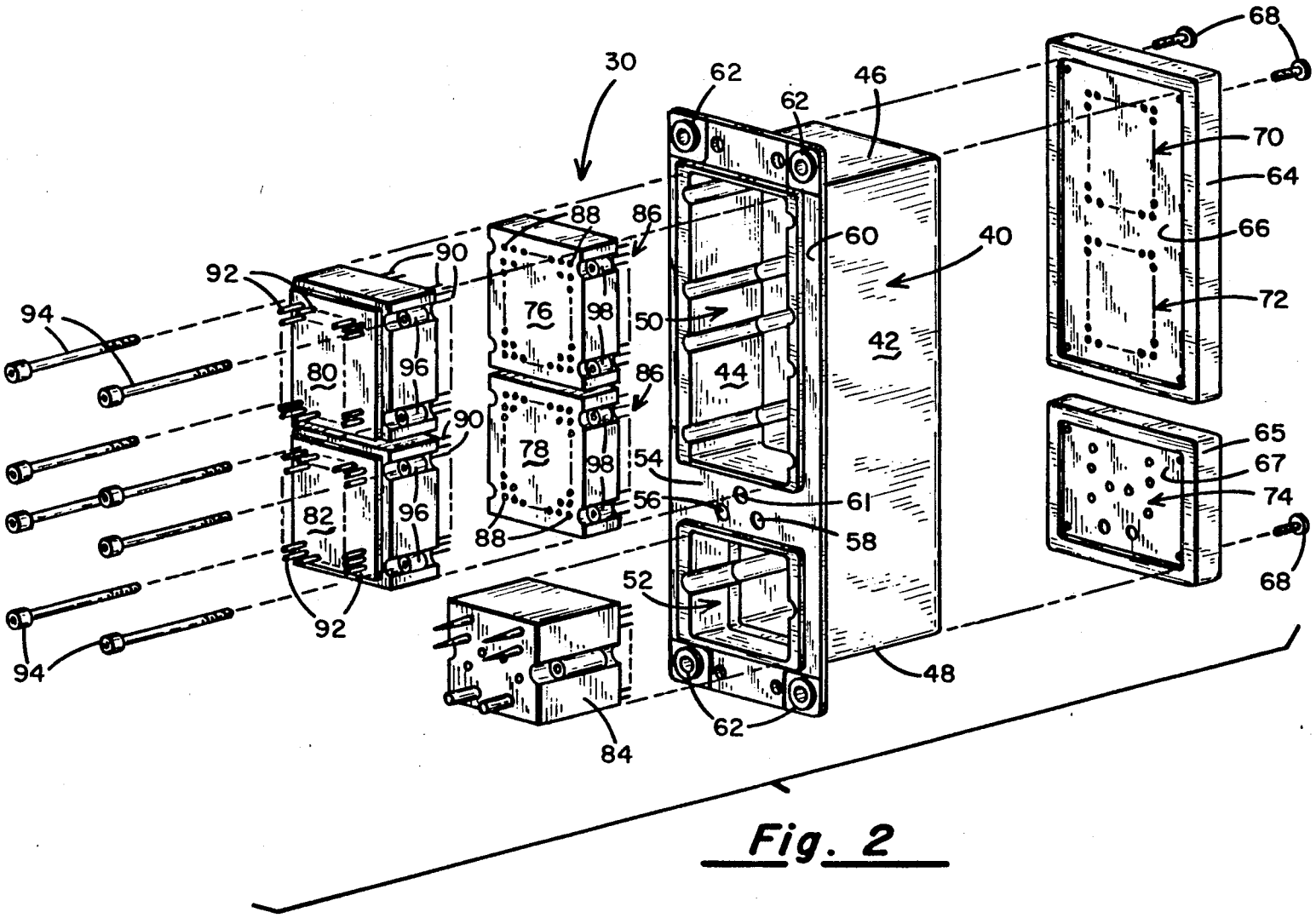
FIG. 2 is a blown-apart view of the electrical connector assembly in accordance with the present invention.

Referring to FIG. 2, the connector receptacle 30 is seen to comprise a shell member 40 having a pair of opposed side walls 42 and 44, a top wall 46 and a bottom wall 48. These four walls define two housing cavities 50 and 52 which are separated from one another by a transverse rib 54 containing a plurality of bores 56, 58 and 61. These bores are adapted to receive polarizing pins (not shown) configured such that only a predetermined male plug arrangement can be made to mate with the connector receptacle 30. The shell 40 is preferably fabricated from a high grade aluminum alloy suitable for being forged or die cast, but other conductive metals may also be used.

Integrally formed with and surrounding the perimeter of the shell 40 at the front face thereof is an outwardly extending flange 60. Float mounts 62 may be disposed at the four corners thereof if desired. When affixed to the front surface 14 of the electronics housing or box 10, the float mount 62 permit the connector receptacle 30 to shift position, within narrow limits, so that when a plug is inserted into the receptacle, the receptacle tends to self-center relative to the pin terminals of the plug.

Affixed to the rear perimeter of the shell 40 is a rectangular frame 64 in which is fitted a substrate 66 made from an insulating material and having a predetermined pattern of female socket contacts extending therethrough. The frame 64 may be one piece or two and is arranged to be held in place on the rear face of the shell 40 by means of fasteners as at 68.

The pattern of socket contacts on the substrate 66 corresponds with the pattern and spacing of the contact pins of the plug designed to mate with the receptacle of the present invention. Thus, for an ARINC 600 style of plug, the pattern 70 comprises a grid having 15 rows and 10 columns with the center-to-center spacing of each hole being 0.1 inch. The pattern 72 is substantially identical to the pattern 70, i.e., a 15×10 grid. The pattern 74 includes a lesser number of socket contacts, e.g., 10, to accommodate the power connections as distinguished from the signal connections which are made through the socket contact pattern 70 and 72, all as will be further described.

While not shown in FIG. 2, projecting outwardly from each of the socket contacts on the rear surface of the substrate 66 are a plurality of terminal pins which are identified by numeral 32 in the view of FIG. 1. It is to these terminal pins that connections are made, either by discrete wiring or by flex circuits, to the terminals on the motherboard.

With continued reference to FIG. 2, the depth of the shell 40 is designed to be such that EMI/RFI modules 76 and 78 and EMP modules 80 and 82 as well as an EMP/EMI/RFI module 84 can be inserted while still leaving room for the mating plug to also be inserted into the receptacle to its appropriate depth.

The EMI/RFI modules 76 and 78 contain a low pass filter network for each of the terminal pins contained within it. The terminal pins themselves are hermaphroditic in that they each include a female socket on one end and a male pin on the other. These terminals are on the same center-to-center spacing as the patterns 70 and 72 of socket contacts on the substrate 66. The male pin portions of the terminal pins in the EMI/RFI module 76 and 78 are identified by numeral 86 and the corresponding female sockets thereof by numeral 88.

The EMI/RFI modules 76 and 78, and the EMP modules 80 and 82, as well as module 84 having both EMP and EMI/RFI protection functions may be constructed by a variety of techniques, including among others, those particularly described in U.S. Pat. No. 4,699,590 issued to Farrar et al, U.S. Pat. No. 4,747,789 issued to Gliha, U.S. Pat. No. 4,820,174 issued to Farrar et al, and U.S. Pat. No. 5,057,041 issued to Yu et al. Of course, the construction details of the aforementioned patents require proper mating male and female pin types, and mating geometry to fit within the shell member 40 and provide a secure connection of mating assemblies. All such interfacing modules are within the scope of the present invention.

In a like fashion, the EMP modules 80 and 82 incorporate in them semiconductor diode circuits and/or fusible links for either routing high voltage transient signals to ground or for interrupting the flow of potentially damaging currents to the circuitry contained within the box 10. The modules 80 and 82 also include an array of hermaphroditic pins having male portions 90 and female socket portions 92. The same center-to-center spacing is employed for the pins in the EMP modules as is used on the EMI/RFI modules and on the patterns 70 and 72 on the substrate 60.

Module 84, as aforesaid, contains both EMP and EMI/RFI protection components for the power connections.

Once the EMP modules 80 and 82 are plugged into the RFI/EMI modules 76 and 78 and the pins of the those two latter modules are plugged into the socket contact patterns 70 and 72, the assembly may be held snugly together against shock and vibration forces by means of threaded bolts 94 which pass through tubular sleeves 96 and 98 integrally formed on the side walls of the modules and into threaded bores formed in the frame member 64.

Figure 3:
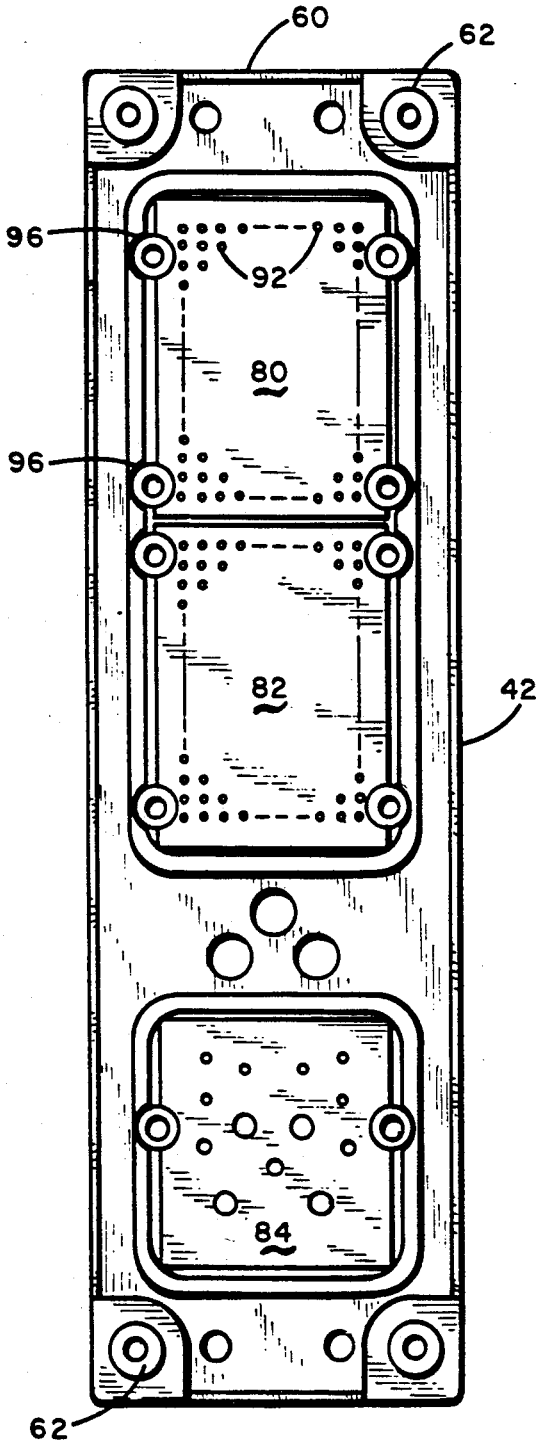
FIG. 3 is a front elevation view of the connector receptacle.
Figure 4:
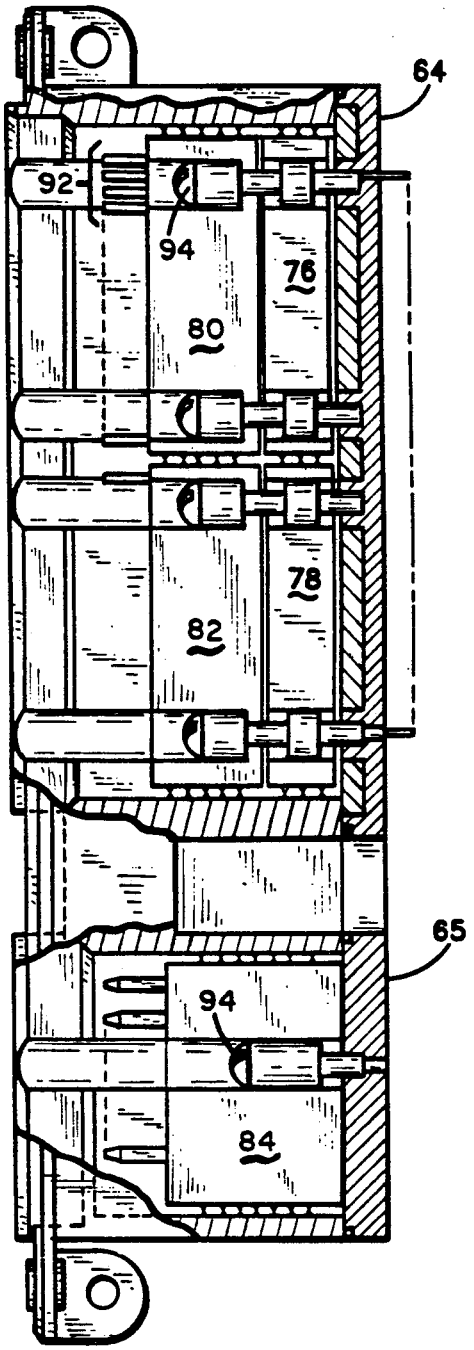
FIG. 4 is a partially sectioned side view of the connector receptacle.

FIGS. 3 and 4 respectively show the receptacle of the present invention when viewed from the front and from the side. In FIG. 4, the side wall is broken away to clearly illustrate the internal features of the plug receptacle when in its assembled form. It is to be especially noted that the modules 76, 78, 80, 82 and 84 have a metal wall surface and associated grounding springs which are firmly in contact with the metal shell 30, establishing a solid ground connection for the protection circuits within the modules.

Because the design of the receptacle of the present invention incorporates front removable protection modules, it is extremely easy and quick to replace a module should it become defective. There is no need to enter the box itself in order to effect repairs to the EMI/RFI/EMP protective devices. Mean-time-to-repair has been reduced from about 30 hours to 10 minutes through the use of the present invention as compared to the receptacle which the present invention is designed to replace.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, for test purposes it has been found expedient to fabricate module inserts having so-called "feed-through" pins. These modules are preferably dimensioned identically to the EMI/RFI module of 76 and 78, the EMP module 80 and 82 or the EMP/EMI/RFI module 84 but differ therefrom in that they do not embody active or passive electronic components, such as semiconductors, resistors, capacitors and the like. By employing the feed-through module or modules within the connector receptacle, the ARINC 600 plug can be made to mate with the receptacle 30 even though the depth dimension of the shell 42 is greater than the existing ARINC 600 plug receptacle.

What is claimed is:

1. An electrical connector receptacle for allowing connection of electronic apparatus contained with a shielding enclosure to a multi-conductor wiring harness terminating in an industry standard plug of the type having a plurality of male pins arranged in a grid of rows and columns, the connector receptacle comprising:

(a) a generally rectangular, box-like conductive shell mounted in a wall of said shielding enclosure, said shell having four mutually perpendicular side walls defining a housing cavity having open front and rear faces, said housing cavity dimensioned to receive said plug when inserted through said open front face;

(b) a frame member removably attached to said shell proximate said open rear face and supporting a flat substrate containing a plurality of socket contacts, the socket contacts being arranged in a grid pattern of rows and columns and being spaced the same as the spacing of the contact pins of said plug;

(c) a plurality of terminal pins joined to said socket contacts and projecting outwardly with respect to said shell to which said electronic apparatus may be connected;

(d) at least one EMI/RFI module, said module comprising a generally rectangular block dimensioned to fit within said housing cavity through said open front face and having first and second opposed major surfaces, said block including a plurality of contact pins extending between said first and second opposed major surfaces and spaced in accordance with said grid pattern, said plurality of contact pins having a first end insertable into said socket contacts on said substrate and a second end defining a female socket;

(e) filter circuit means in said EMI/RFI module and operatively coupled between selected ones of said contact pins and said conductive shell for attenuating high frequency noise signals;

(f) at least one EMP module, said module comprising a generally rectangular block having first and second opposed major surfaces, being insertable into said housing cavity through said open front face and including a plurality of contact pins extending between said first and second opposed surfaces of said EMP module and spaced in accordance with said grid pattern, said plurality of contact/pins in said EMP module having a first end insertable into said female socket of said contact pins of said EMI/RFI module and a second end defining a female socket for receiving one of said male pins; and (g) transient voltage suppression means in said EMP module and operatively coupled between selected ones of said contact pins and said conductive shell for creating an active barrier between transient spikes induced in said wiring harness and said electronic apparatus in said shielding enclosure.

2. The electrical connector receptacle as in claim 1 wherein at least some of said pins in said EMP module include a fuse link.

3. The electrical connector receptacle as in claim 1 wherein said filter circuit means is a low pass filter including a series capacitor and a shunt inductor.

4. The electrical connector receptacle as in claim 1 wherein said transient voltage suppression means includes at least one semiconductor chip including at least one active element.

5. The electrical connector receptacle as in claim 4 wherein said active element is a zener-type diode operatively coupled between selected ones of said contact pins and said shell.

6. The electrical connector receptacle as in claim 1 wherein said industry standard plug is an ARINC 600 plug.

7. The electrical connector receptacle as in claim 1 wherein the spacing between rows and columns of said socket contacts is 0.100 inch.

8. An electrical connector receptacle for operatively coupling an electronics module to a multi-contact cable plug, comprising:

(a) a conductive shell defining a cavity having open front and rear faces;

(b) a removable frame attached to said shell and surrounding said rear face, said frame being of one or more pieces supporting at least one substrate having a grid pattern of socket contacts corresponding to the pattern of contacts on said cable plug;

(c) at least one EMI noise suppression module including a plurality of hermaphroditic contact pins having male and female terminal portions and active or passive circuit components operatively connected to said plurality of contact pins and to said shell for attenuating EMI noise induced in the cable to which said cable plug is attached;

(d) means for mounting said noise suppression module within said cavity with said male terminal portion of said contact pins disposed in said socket contacts; and (e) an EMP module insertable into said shell cavity and including a plurality of hermaphroditic contact pins having male and female portions and active and passive circuit components operatively coupled between said contact pins of said EMP module and said shell for creating an EMP barrier, said male portions of said contact pins of said EMP module being plugable into said female terminal portions of said contact pins of said EMI noise suppression module and said contacts of said plug insertable into said female portion of said contact pins of said EMP module when said plug is inserted into said cavity through said open face,

9. The electrical connector receptacle as in claim 8 wherein at least some of said pins of said EMP module include a fuse link.

10. The electrical connector receptacle as in claim 8 wherein said active and passive circuit components comprise a semiconductor chip.

11. An electrical connector receptacle for allowing connection of an electronic apparatus contained within a shielding enclosure to a multi-conductor wiring harness terminating in a plug of the type having a plurality of male pins arranged in a selected grid pattern, the connector receptacle comprising:

(a) a box-like conductive shell mounted in a wall of said shielding enclosure, said shell having wall surfaces defining a housing cavity having open front and rear faces, said housing cavity dimensioned to receive said plug when inserted through said open front face;

(b) a frame member removably attached to said shell proximate said open rear face and supporting a flat substrate containing a plurality of socket contacts, the socket contacts being arranged in said selected grid pattern and being spaced the same as the spacing of the contact pins of said plug;

(c) a plurality of terminal pins joined to said socket contacts and protecting outwardly with respect to said shell to which said electronic apparatus may be connected;

(d) at least one EMI/RFI module, said module comprising a block dimensioned to fit within said cavity through said open front face and having first and second opposed major surface, said block including a plurality of contact pins extending between said first and second opposed major surfaces and spaced in accordance with said selected grid pattern, said plurality of contact pins having a first end insertable into said socket contacts on said substrate and a second end defining a female socket;

(e) filter circuit means in said EMI/RFI module and operatively coupled between selected ones of said contact pins and said conductive shell for attenuating high frequency noise signals;

(f) at least one EMP module, said module comprising a block having first and second opposed major surfaces, being insertable into said housing cavity through said open front face and including a plurality of contact pins extending between said first and second opposed surfaces of said EMP module and spaced in accordance with said selected grid pattern, said plurality of contact/pins in said EMP module having a first end insertable into said female socket of said contact pins of said EMI/RFI module and a second end defining a female socket for receiving one of said male pins; and (g) transient voltage suppression means in said EMP module and operatively coupled between selected ones of said contact pins and said conductive shell for creating an active barrier between transient spikes induced in said wiring harness and said electronic apparatus in said shielding enclosure.

12. The electrical connector receptacle as in claim 11 wherein said plug is an industry standard ARINC 600 plug.

13. The electrical connector receptacle as in claim 11 wherein said selected grid pattern is a plurality of rows and columns and the spacing between said rows and columns of said socket contacts is 0.100 inch.

* * * * *